US005391087A

United States Patent [19]

Fukuda

[11] Patent Number: 5,391,087

[45] Date of Patent: Feb. 21, 1995

[54] CONNECTOR

[75] Inventor: Masaru Fukuda, Shizuoka, Japan

[73] Assignee: Yazaki Corporation, Tokyo, Japan

[21] Appl. No.: 164,752

[22] Filed: Dec. 10, 1993

[30] Foreign Application Priority Data

Dec. 14, 1992 [JP] Japan ..... 4-333076

[51] Int. Cl.[6] ..... H01R 29/00

[52] U.S. Cl. ..... 439/188; 439/489

[58] Field of Search ..... 439/188, 350, 489, 352, 439/490, 357; 200/51 R, 51.09-51.11

[56] References Cited

U.S. PATENT DOCUMENTS 5,145,356 9/1992 Minnis ..... 439/188 X
5,192,225 3/1993 Suzuki ..... 439/489

FOREIGN PATENT DOCUMENTS 1-77287 5/1989 Japan .
2-50982 4/1990 Japan .

*Primary Examiner*—Khiem Nguyen
*Attorney, Agent, or Firm*—Finnegan, Henderson, Farabow, Garrett & Dunner

[57] ABSTRACT

A connector is constructed to prevent an electronic circuit from being erroneously activated due to electric current induced when a female connector housing and a male connector housing are disconnected from each other, and moreover, ensure that a locked connection detecting circuit is activated when both the connector housings are connected to each other in the locked state. The connector includes a male connector housing having a flexible locking arm and chambers for respectively receiving a plurality of terminals; a female connector housing having an engagement member for engaging the flexible locking arm of the male connector housing; a lock detecting member for detecting a locking condition of the male and the female connector housings by releasing the lock detecting member from the male connector housing when the female connector housing is connected to the male connector housing; and a short circuit member for short-circuiting terminals accommodating the receiving chambers of the male connector housing when the male connector housing and the female connector housing are in a disconnected state, and for short-circuiting the terminals of the female connector housing to complete a lock condition detecting circuit when the male connector housing and the female connector housing are in a connected and locked condition.

4 Claims, 6 Drawing Sheets

FIG. 8 (A) PRIOR ART
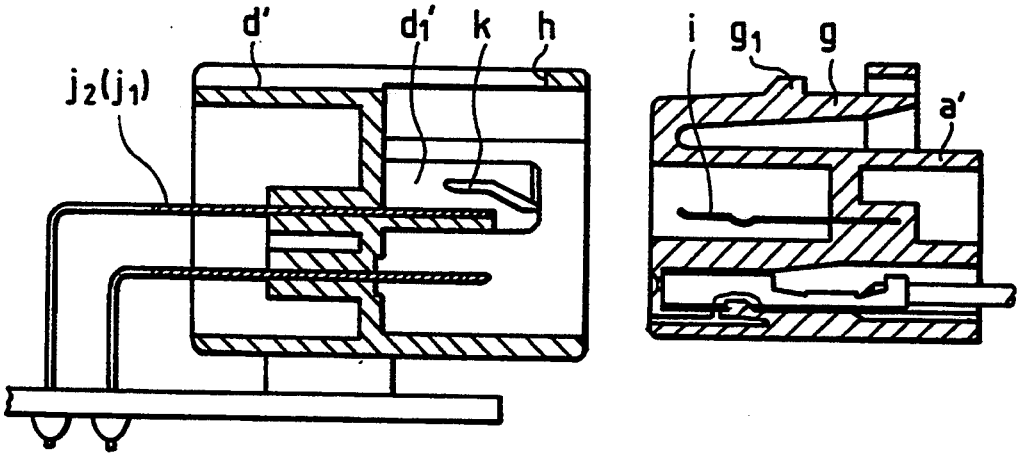
FIG. 8 (B) PRIOR ART
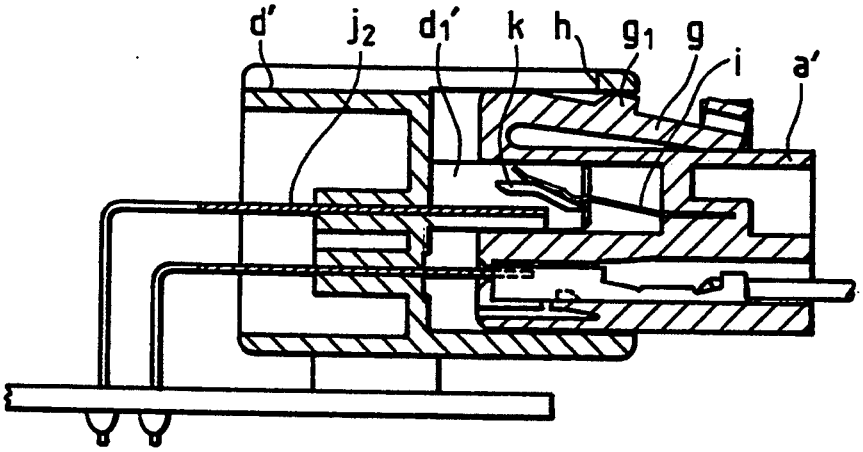
FIG. 8 (C) PRIOR ART
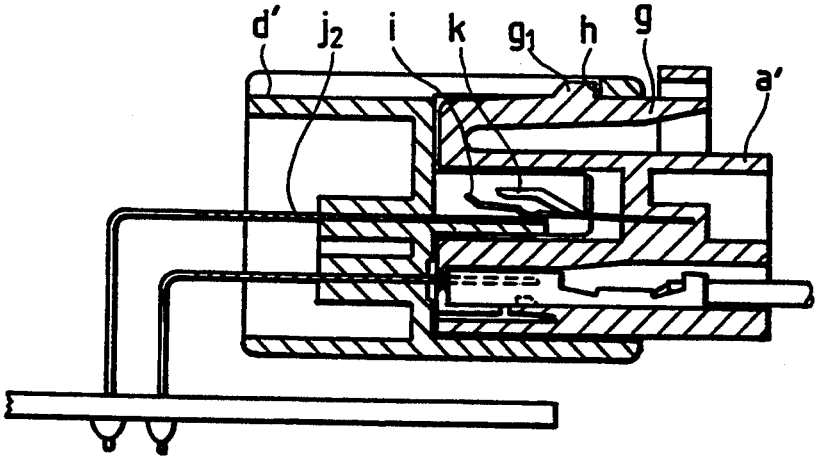

CONNECTOR

BACKGROUND OF THE INVENTION

1. Field of the invention

The present invention relates to a technology for preventing an electronic circuit electrically connected to one of a pair of connectors from being erroneously activated due to the flowing of an electric current introduced by an electromagnetic wave propagated from the outside, static electricity or the like when the pair of connectors are disconnected from each other and a plurality of male terminals and a plurality of female terminals are then disengaged from each other.

2. Related art

In FIG. 6 and FIG. 7, a female connector housing a includes a female terminal receiving chamber $a_2$ having an opening portion $a_1$ to cooperate with a male terminal on the fitting surface side, a short circuit member receiving chamber $a_4$ having a closure wall $a_3$ on the fitting surface side, and an electrical insulative member receiving chamber $a_6$ having an opening portion $a_5$ for an electrical insulative member on the fitting surface side while making a communication between the short circuit member receiving chamber $a_4$ and the female terminal receiving chamber $a_6$ via the electrical insulative member receiving chamber $a_6$ in side-by-side relationship. A pair of female terminals b are fitted into the female terminal receiving chamber $a_2$, and a short circuit member c for making a communication between the female terminals b is resiliently received in the short circuit member receiving chamber $a_4$. A pair of male terminals e are fitted into a male connector housing d which forms a guide hood $d_1$ for the female connector housing, and a flat plate-shaped electrical insulative member f adapted to be received between the short circuit member c and the male terminals b when the female connector housing a and the male connector housing d are connected to each other. When a female connector and a male connector are disconnected from each other (see FIG. 6), the short circuit member c serves to make a connection between both the female terminals b so as not to allow any differential voltage to appear between adjacent terminals in a connector housing located on the instrument side at the time of inspection. Thus, the instrument can not be erroneously activated.

Each of the female connector housing a and the male connector housing d is equipped with a hitherto known fitting/locking mechanism (not shown) but not equipped with a device or a unit for confirming whether or non they are completely connected to each other. Thus, there appears a problem that it can not be assured that an air bag will operate properly.

FIG. 8 and FIG. 9 show another conventional connector which is equipped with a device or a unit for confirming whether or not a female connector housing and a male connector housing are completely connected to each other. The male connector housing a' includes a locking arm g so as to allow a locking projection $g_1$ on the locking arm g to be engaged with an engagement portion h of a female connector housing d' when the male connector housing a' is connected to a female connector housing d' (see FIG. 8(*c*)). The male connector housing a' includes a completely locked state detecting short circuit terminal contoured in the form of a resilient tongue pieces i having a pair of locked state confirming pieces $i_1$ formed at the fore end thereof, while the female connector housing d' includes other state detecting short circuit terminals contoured in the form of stationary contact pieces $j_1$ and $j_2$. In addition, the female connector housing d' includes tapered guide portions k on the opposite inner walls $d_1'$ of the receiving chamber for receiving the stationary contact pieces $j_1$ and $j_2$. When the female connector housing a' and the male connector housing d' are incompletely connected to each other, the short circuit pieces i are parted from the stationary contact pieces $j_1$ and $j_2$ due to the engagement of the locked connection confirming pieces $i_1$ with the guide piece k, whereby the short circuit pieces i are not electrically connected to the stationary contact pieces $j_1$ and $j_2$ (see FIG. 8(B)). On the other hand, when the female connector housing a' and the male connector housing b' are completely connected to each other, the resilient tongue pieces i are resiliently restored to the original position where they come in contact with the stationary contact pieces $j_1$ and $j_2$ while the locked connection confirming pieces $i_1$ are disengaged from the guide portions k, whereby a locked connection detecting circuit (not shown) is activated.

In the case of the conventional connector constructed in the above-described manner, however, there arises a malfunction in that a certain time delay unavoidably appears due to the allowable tolerance relating to the fabrication of the resilient tongue pieces i and the stationary contact pieces $j_1$ and $j_2$ until the resilient tongue pieces i are resiliently lowered to come in contact with the stationary contact pieces $j_1$ and $j_2$, whereby the state of incomplete connection is undesirably detected due to the foregoing time delay in spite of the fact that the completely connected state is attained.

SUMMARY OF THE INVENTION

In view of the forgoing problem, an object of the present invention is to provide a connector structure which is simplified by arranging a short circuit member adapted to serve when a pair of connectors are disconnected from each other as well as a locked connection detecting electrical insulative member adapted to serve as short circuit making means wherein one of the connectors is electrically connected to an electronic circuit such as an air bag circuit or the like and other one is electrically connected to a locked connection detecting circuit.

To accomplish the above object, the present invention provides a connector of the type including a male connector housing having a flexible lock arm disposed thereon, a female connector housing having an engagement portion formed thereon to be engaged with the flexible lock arm, and a locked connection detecting unit preliminarily received in the rear end part of the female connector housing in the engaged state, the locked connection detecting unit being released from the engaged state when the female connector housing and the male connector housing are connected to each other in the locked state, wherein the connector is provided with a plurality of female terminal pieces and a short circuit member including a pair of resilient contact pieces adapted to come in contact with the female terminal pieces are received in the male connector housing, that a plurality of male terminal pieces adapted to cooperate with the female terminal pieces, a short circuit releasing electrical insulative member and a pair of terminal pieces electrically connected to a locked connection detecting circuit are arranged in the female connector housing, that a locked connection detecting electrical insulative member adapted to cooperate with the short circuit member is projected forward of the locked connection detecting unit, that when the female connector housing and the male connector housing are connected to each other in the locked state, the short circuit releasing electrical insulative member is received between the female terminal pieces and the short circuit member, that the pair of terminal pieces electrically connected to the locked connection detecting circuit are located opposite to the pair of resilient contact pieces of the short circuit member with the locked connection detecting electrical insulative member interposed therebetween, and that when the locked connection detecting unit is disconnected from the male connector housing, the terminal pieces electrically connected to the locked connection detecting circuit are electrically connected to each other via the short circuit member.

When the female connector housing and the male connector housing are connected to each other in the locked state, the locked connection detecting circuit is activated by disconnecting the locked connection detecting unit from the male connector housing.

In addition, when the female connector housing and the male connector housing are disconnected from each other, short circuit is made between the female terminal pieces.

BRIEF DESCRIPTION OF THE DRAWINGS

FIG. 8(A) is a sectional view illustrating female and male connector housings of a conventional connector in a disconnected state;

FIG. 8(B) is a sectional view showing the female and male connector housings of FIG. 8(A) in a partially connected state;

FIG. 8(C) is a sectional view showing the female and male connector housings of FIG. 8(A) in a fully connected state.

DETAILED DESCRIPTION OF THE PREFERRED EMBODIMENTS

The present invention will now be described in detail hereinafter with reference to the accompanying drawings which illustrate a preferred embodiment thereof.

Figure 1:
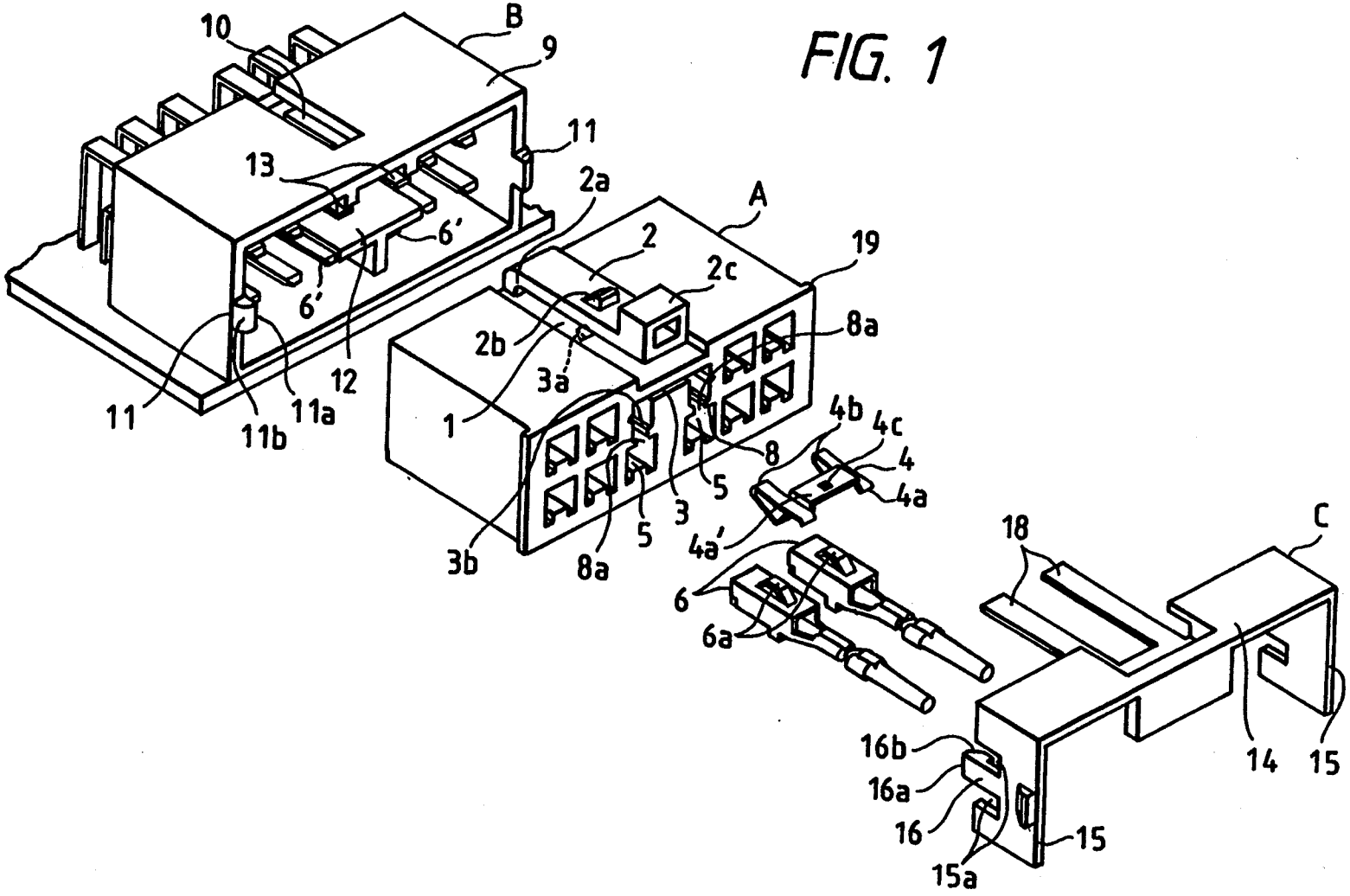
FIG. 1 is a perspective view according to a connector of one embodiment of the present invention.

In FIG. 1, reference character A designates a male connector housing, reference character B designates a female connector housing, and reference character C designates a locked connection detecting unit attached to and detached from the rear part of the male connector housing A.

A groove 1 is formed on the upper surface of the male connector housing A, and a flexible lock arm 2 is disposed on the groove 1 to extend in the rearward direction via an upright standing base portion 2*a* located at the fore end of the male connector housing A. A locking projection 2*b* is formed at the intermediate position of the locking arm 2, while an actuating portion 2*c* is formed at the rear end of the same.

A short circuit member 4 is received in a short circuit member receiving chamber 3 at the middle upper position of the male connector housing A, and two female terminal pieces 6, electrically connected to a signal circuit (not shown) on the air bag load side, are received in a pair of terminal receiving chambers 5 in the lower part of the male connector housing A.

The short circuit member 4 is composed of a short circuit portion 4*a* made of an electrical conductive resilient metallic plate having a small thickness and a pair of arched resilient contact pieces 4*b* connected to the short circuit portion 4*a*. The short circuit member 4 is firmly held by bringing a projection 3*a* on the lower wall of the receiving chamber 3 in engagement with an engagement hole 4*c* formed through a projected part 4*a*' of the short circuit portion 4*a*.

Figure 5:
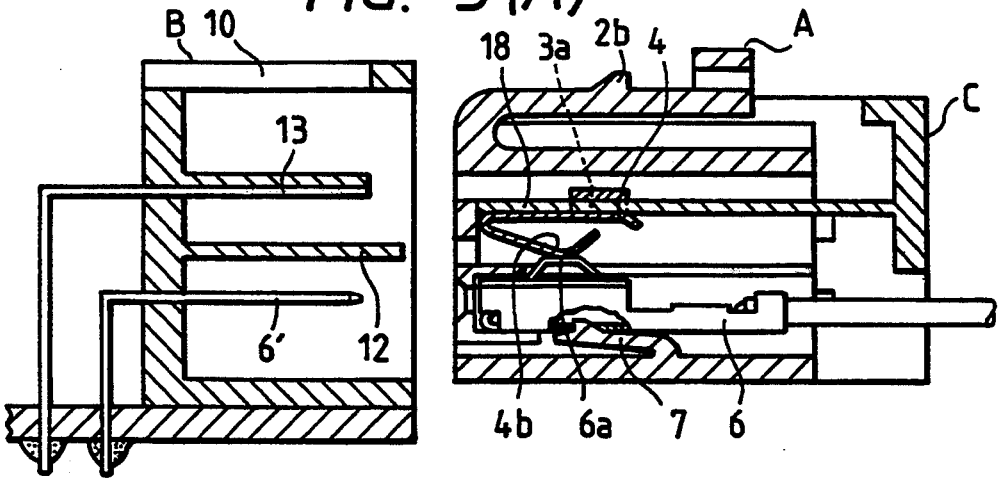
FIG. 5(A) is a sectional view showing the female connector housing and the male connector housing in a disconnected state.
FIG. 5(B) is a sectional view showing the female and male connector housings of FIG. 5(A) in a connected state.
FIG. 5(C) is a sectional view showing the released locked connection detecting unit being withdrawn from the connected male and female connector housings of FIG. 5(A)
Figure 5:
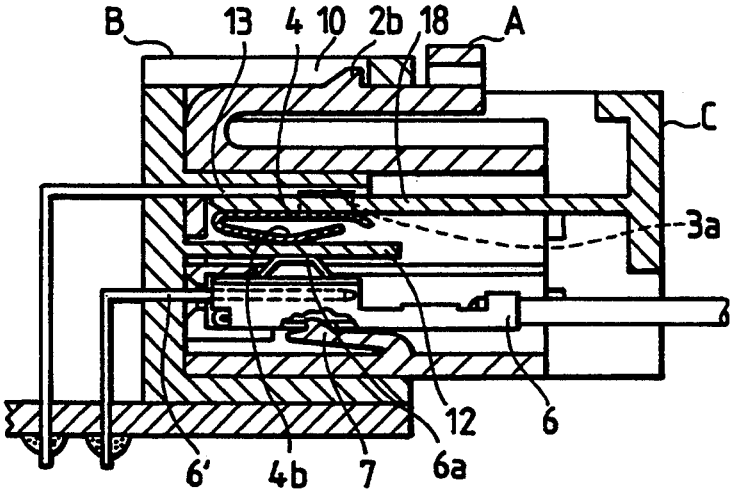
Figure 5:
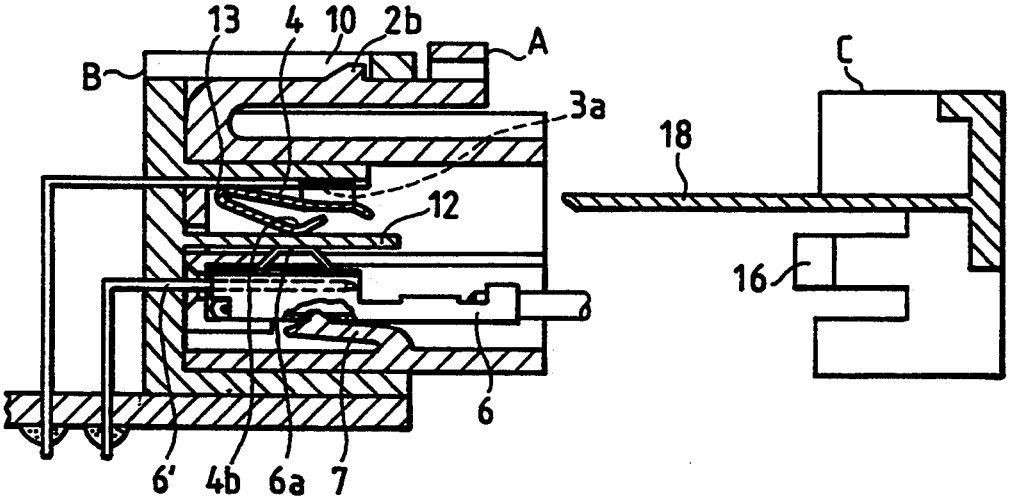
Figure 6:
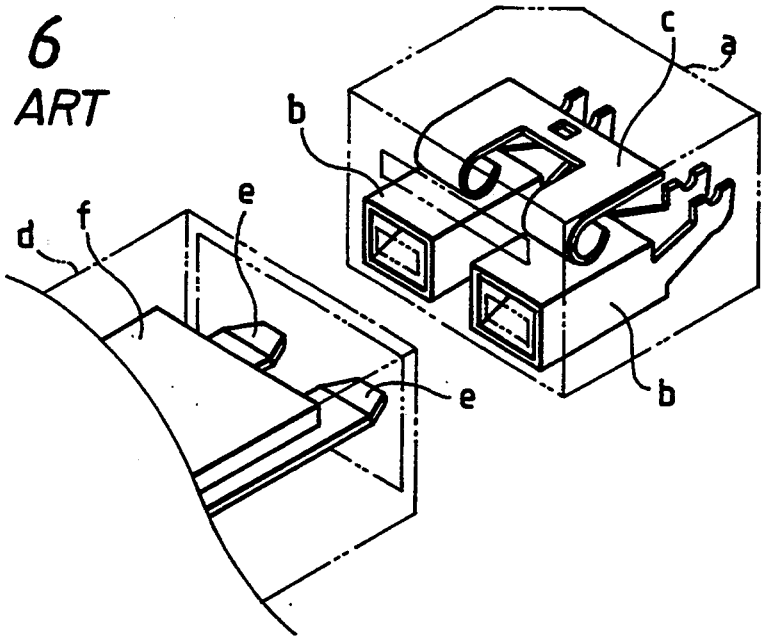
FIG. 6 PRIOR ART
FIG. 6 is a perspective view of a conventional connector showing essential components constituting the connector in the disassembled state.
Figure 7:
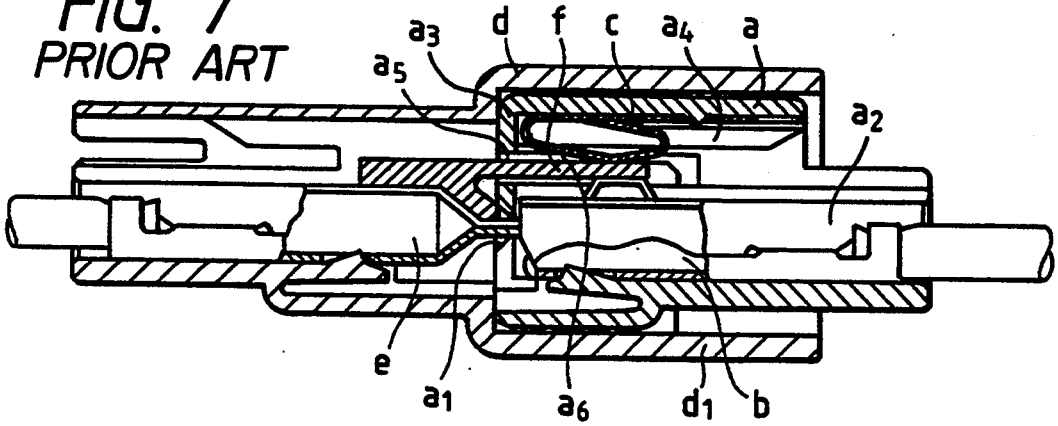
FIG. 7 PRIOR ART
FIG. 7 is a sectional view of the conventional connector showing that the essential components are assembled together.
Figure 9:
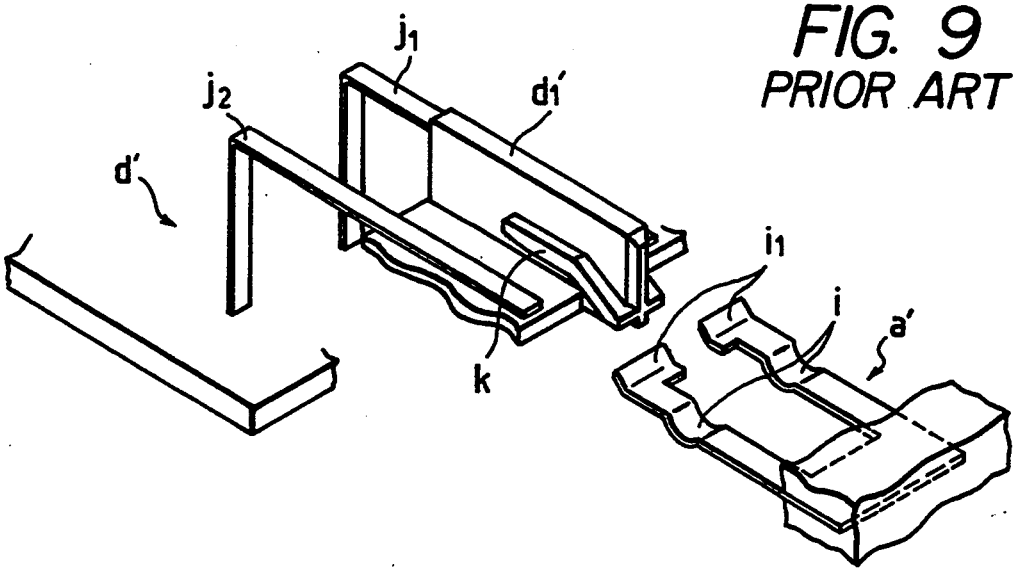
FIG. 9 PRIOR ART
FIG. 9 is a perspective view of the conventional connector shown in FIG. 8, showing essential components constituting the conventional connector.

When each female terminal piece 6 is inserted into the corresponding terminal receiving chamber 5, it is engaged with a flexible engagement piece 7, and at this time, a contact projection 6*a* formed on the upper surface of the female terminal piece 6 is received in the short circuit receiving chamber 3 via a slit 8*a* formed through a partition wall 8 to come in contact with the arched contact piece 4*b* of the short circuit member 4, whereby a pair of female terminal pieces 6 are electrically connected to each other via the short circuit member 4 (see FIG. 5(A)).

An engagement portion 10 adapted to be engaged with the locking projection 2*b* on the lock arm 2 is formed by cutting out a part of a sheath portion 9 of the female connector B, and a pair of engagement releasing projections 11, each having an outward orienting tapered driving surface 11*b*, are projected in the forward direction on opposite sides of the female connector housing B. A plate-shaped short circuit releasing electrical insulative member 12 is disposed in the central middle part of the sheath portion 9 of the female connector housing B, and a pair of terminal pieces 13 electrically connected to a locked connection detecting circuit (not shown) are formed above the electrical insulative member 12. In addition, a pair of male terminal pieces 6', connected to an power supply for the air bag device, and electrically connected to a signal circuit (not shown) are formed below the electrical insulative member 12.

The locked connection detecting unit C is designed in a substantially inverted U-shaped contour and includes a ceiling plate 14 and a pair of side plates 15 extending downward from opposite sides of the ceiling plate 14. Resilient engagement pieces 16, each having an engagement projection **16*a*, are formed on the fore end parts of both the side plates 15, while a pair of slits 15*a* are located on the opposite sides of the engagement pieces 16, and a tapered driven surface 16*b* is formed on each engagement projection 16*a* on the inside of the latter. In addition, a stopper 17 is disposed behind the engagement projection 16*a* on the inside of each side plate 15 in the spaced relationship relative to the engagement projection 16*a* (see FIG. 3). A bifurcated locked connection detecting electrical insulative member 18 extends forward of the ceiling plate 14** at the central part of the latter.

With this construction, the engagement projections **16*a* on the resilient engagement pieces 16 of the locked connection detecting unit C are preliminarily engaged with engagement projections 19 at the rear end of the male connector housing A on the opposite sides of the latter. Subsequently, while the stoppers 17 collide against with the engagement projections 19, the locked connection detecting unit C is displaced in the forward direction until it is connected to the male connector housing A (see FIG. 2(A) and FIG. 3 (A)). At this time, as the bifurcated electrical insulative member 18 is received in corrective grooves 3*b* of the short circuit member receiving chamber 3, it is brought in engagement with the resilient contact pieces 4*b* of the short circuit member 4** (see FIG. 4 and FIG. 5(A)).

Figure 2:
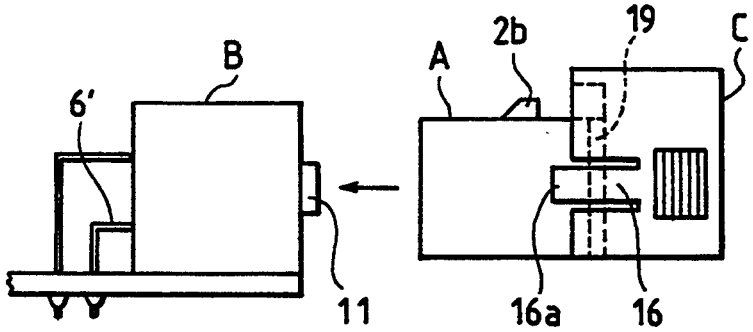
FIG. 2(A) is a sideview of a female connector housing and a male connector housing in a disconnected state.
FIG. 2(B) is a sideview illustrating the male and female connector housings of FIG. 2(A) in a partially connected state.
FIG. 2(C) is a sideview showing the female and male connector housings of FIG. 2(A) in a connected state.
FIG. 2(D) illustrates the release of a locked connection detection unit from the male connector housing once the male and female connector housings of FIG. 2(A) are in a fully connected state.
Figure 2:
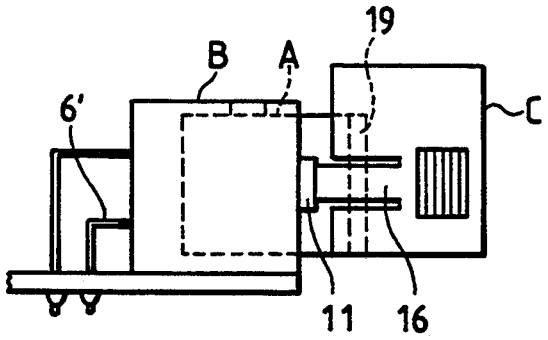
Figure 2:
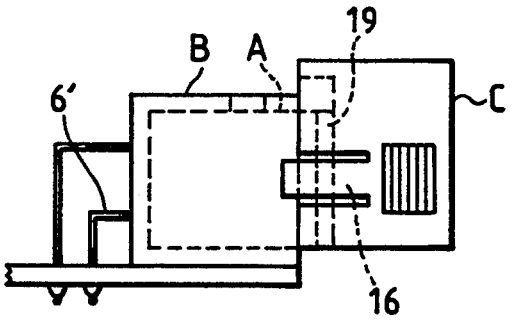
Figure 2:
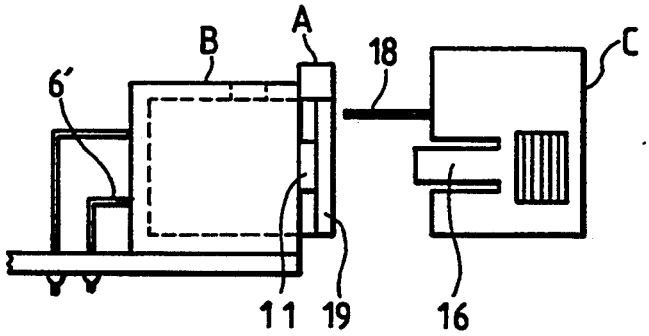
Figure 3A:
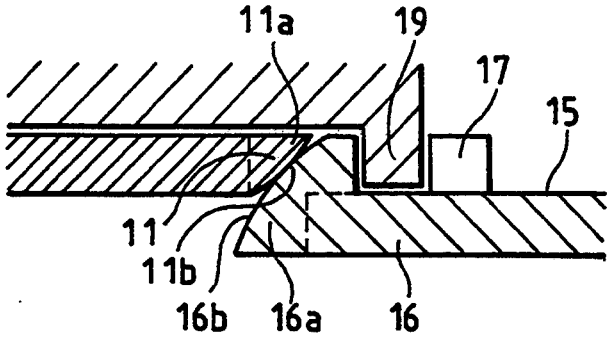
FIG. 3(A) is a fragmentary, enlarged sectional view illustrating the locked connection of the locked connection detecting unit to the male connector housing.
Figure 4:
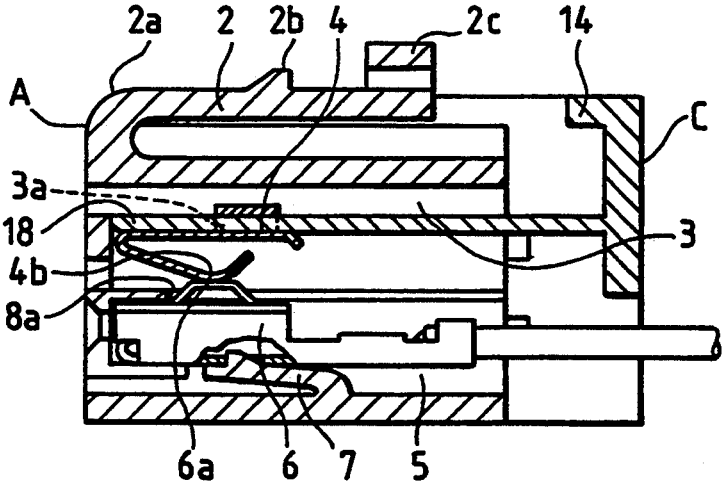
FIG. 4 is a fragmentary enlarged sectional view of the connector showing the state that the locked connection detecting unit is assembled with a male connector housing.

When the male connector housing A is fitted into the female connector housing B with the locked connection detecting unit C seized by an operator's hand while the foregoing state is maintained, the locking projection **2*b* of the flexible lock arm 2 comes in contact with the fore end of the sheath portion 9 of the female connector housing B, whereby the flexible lock arm 2 is displaced in the downward direction (see FIG. 2 (A) and FIG. 3(A)). When the male connector housing A is completely fitted into the female connector housing B, the flexible lock arm 2 is restored to the original state that the locking projection 2*b* is engaged with the engagement portion 10 so that the terminal pieces 6 and 6' electrically connected to an air bag circuit (not shown) are connected to each other. At this time, the electrical insulative member 12 of the female connector housing B is received between the resilient contact pieces 4*b* and the contact projections 6*a* so that the short circuit between both the female terminal pieces 6 is canceled, and moreover, the pair of terminal pieces 13 electrically connected to the locked connection detecting circuit are relatively displaced by the locked connection detecting electrical insulative members 18 while depressing the resilient contact pieces 4*b*** (see FIG. 2(C) and FIG. 5(B)).

Figure 3B:
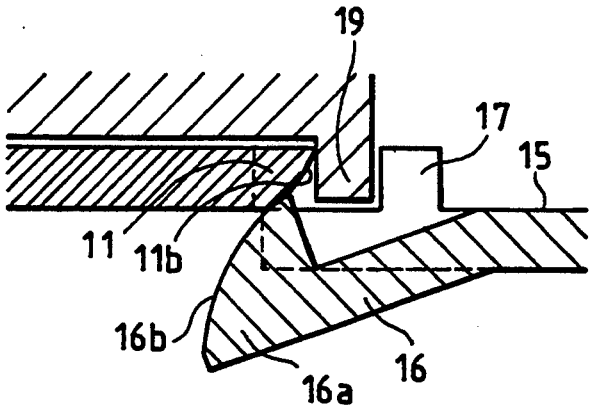
FIG. 3(B) is a fragmentary enlarged sectional view corresponding to FIG. 3(A), illustrating release of the locked connection detecting unit from the male connector housing.

When complete locked connection is made, the tapered driving surfaces **11*b* of the engagement releasing projections 11 on the female connector housing B side serve to outwardly displace the resilient engagement pieces 16 via the tapered driven surfaces 16*c* so as to allow the engagement projections 16*a* to be disengaged from the engagement projections 19 (see FIG. 3(B)). Subsequently, when the locked connection detecting unit C is disconnected from the male connector housing A while the foregoing state is maintained, the electrical insulative member 18 is disengaged from the short circuit member receiving chamber 3, whereby the locked connection detecting circuit is activated because the pair of terminal pieces 13 are electrically connected to each other via the short circuit member 4**.

As described above, according to the present invention, there is provided a connector of the type including a male connector housing having a flexible lock arm disposed thereon, a female connector housing having an engagement portion formed thereon to be engaged with the flexible lock arm, and a locked connection detecting unit preliminarily received in the rear end part of the female connector housing in the engaged state, the locked connection detecting unit being released from the engaged state when the female connector housing and the male connector housing are connected to each other, wherein the connector is provided with a plurality of female terminal pieces and a short circuit member adapted to come in contact with the female terminal pieces are received in the male connector housing, that a plurality of male terminal pieces adapted to cooperate with the female terminal pieces, a short circuit releasing electrical insulative member and a plurality of terminal pieces electrically connected to a locked connection detecting circuit are arranged in the female connector housing, that a locked connection detecting electrical insulative member adapted to cooperate with the short circuit member is projected forward of the locked connection detecting unit, that when the female connector housing and the male connector housing are connected to each other in the locked state, the short circuit releasing electrical insulative member is received between the female terminal piece and the short circuit member, that the terminal pieces electrically connected to the locked connection detecting circuit are located opposite to the resilient contact pieces of the short circuit member with the locked connection detecting electrical insulative member interposed therebetween, and that when the locked connection detecting unit is disconnected from the male connector housing, the terminal pieces electrically connected to the locked connection detecting unit are electrically connected to each other via the short circuit member. With such construction, when the female connector housing and the male connector housing are disconnected from each other for the purpose of performing a repair operation and an inspection service, there does not arise a malfunction that a circuit disposed on the air bag load side or the like is erroneously activated due to the feeding of an undesirably induced electric current. In addition, when the female connector housing and the male connector housing are connected to each other in the locked state, a locked connection detecting circuit can be activated. Since a single short circuit member serves not only for the purpose of preventing the short circuit member from being erroneously actuated but also for the purpose of detecting whether the locked connection is reliably made or not. This makes it possible that the whole connector is constructed in a compact manner.

What is claimed is:

1. A connector comprising:

a male connector housing having a flexible locking arm and chambers for respectively receiving a plurality of first terminals;

a female connector housing having an engagement member for engaging the flexible locking arm of the male connector housing, a plurality of second terminals, and a pair of detecting circuit terminals;

a lock detecting member for detecting a locked condition of the male and female connector housings when the lock detecting member is released from the male connector housing upon connection of the female connector housing to the male connector housing with pairs of the first and second terminals in engaged relation; and a short circuit member for short-circuiting the first terminals accommodated in the chambers of the male connector housing when the male connector housing and the female connector housing are in a disconnected state, and for short-circuiting the pair of detector circuit terminals in the female connector housing when the male connector housing and the female connector housing are in the locked condition.

2. A connector as defined in claim 1, wherein the lock detecting member includes:

a locking connection detection member fitted to an end portion of the male connector housing, the locking connection detection member being connected to the male connector housing when the male connector housing and the female connector housing are in the disconnected state, the locking connection detection member being provided with engagement pieces formed on an end portion of the locking connection detecting member; and engagement releasing projections provided at an end portion of the female connector housing, the engagement releasing projections engaging the engagement pieces to disconnect the locking connection detection member from the male connector housing when the male connector housing is connected to the female connector housing.

3. A connector as claimed in claim 2, wherein the lock detecting member further includes an insulating arm for inhibiting the short-circuiting of the detection circuit terminals by the short circuit member until the disconnected locking connection detection member is withdrawn from the male connector housing.

4. A connector as claimed in claim 1, wherein the lock detecting member further includes an insulating arm for inhibiting the short-circuiting of the detection circuit terminals by the short circuit member until the lock detecting member is released and withdrawn from the male connector housing.

* * * * *